US006612914B2

(12) United States Patent
Gurusamy et al.

(10) Patent No.: US 6,612,914 B2
(45) Date of Patent: Sep. 2, 2003

(54) PLATEN WITH LATERAL WEB TENSIONER

(75) Inventors: Jayakumar Gurusamy, Newark, CA (US); Gee Sun Hoey, San Jose, CA (US)

(73) Assignee: Applied Materials Inc., Santa Clara, CA (US)

( * ) Notice: Subject to any disclaimer, the term of this patent is extended or adjusted under 35 U.S.C. 154(b) by 21 days.

(21) Appl. No.: 09/738,031

(22) Filed: Dec. 14, 2000

(65) Prior Publication Data

US 2002/0127959 A1 Sep. 12, 2002

(51) Int. Cl.[7] ..... B24B 7/22
(52) U.S. Cl. ..... 451/173; 451/520
(58) Field of Search ..... 451/173, 288, 451/168, 310, 520, 41

(56) References Cited

U.S. PATENT DOCUMENTS

| | | | | | |
|---|---|---|---|---|---|
| 1,353,967 | A | * | 9/1920 | Lorenz | 451/494 |
| 2,399,924 | A | * | 5/1946 | Hayward | 451/259 |
| 5,335,453 | A | * | 8/1994 | Baldy et al. | 451/173 |
| 5,704,827 | A | | 1/1998 | Nishi et al. | 451/285 |
| 6,068,542 | A | * | 5/2000 | Hosokai | 451/37 |

FOREIGN PATENT DOCUMENTS

| | | | | |
|---|---|---|---|---|
| DE | 2637343 | * | 2/1978 | 451/307 |
| GB | 0117656 | * | 7/1918 | 451/494 |

OTHER PUBLICATIONS

Somer et al. "Polishing Media Stabilizer" U.S. patent application Ser. No. 09/258,036, filed Feb. 25, 1999.

Birang et al. "Apparatus and Methods for Chemical Mechanical Polishing with an Advanceable Polishing Sheet" U.S. patent application Ser. No. : 09/244456, filed Feb. 4, 1999.

* cited by examiner

*Primary Examiner*—Robert A. Rose
(74) *Attorney, Agent, or Firm*—Moser, Patterson & Sheridan

(57) ABSTRACT

Generally, a method and apparatus for retaining a web of polishing material is provided. In one embodiment, an apparatus for retaining a web of polishing material includes a platen that has a first clamp and a second clamp disposed on opposite sides of the platen. A top surface of the platen is adapted to support the web of polishing material in an orientation having the web's edges disposed approximate the first and second sides of the platen. The first and second clamps are actuated to laterally tension the web therebetween.

37 Claims, 5 Drawing Sheets

PLATEN WITH LATERAL WEB TENSIONER

BACKGROUND OF THE DISCLOSURE

1. Field of Invention

The embodiments of the present invention generally relate to a method and apparatus for supporting a web of polishing material in a polishing system.

2. Background of Invention

In semiconductor wafer processing, the use of chemical mechanical planarization, or CMP, has gained favor due to the enhanced ability to increase device density on a semiconductor workpiece, or substrate, such as a wafer. Chemical mechanical planarization systems generally utilize a polishing head to retain and press a substrate against a polishing material while providing motion therebetween. Some planarization systems utilize a polishing head that is moved over a stationary platen that supports the polishing material. Other systems utilize other motions, for example, providing a rotating platen. A polishing fluid is typically disposed between the substrate and the polishing material during polishing to provide chemical activity that assists in the removal of material from the substrate. Some polishing fluids also contain abrasives.

One type of polishing material that may be utilized for chemical mechanical polishing is known as fixed abrasive polishing material. Fixed abrasive polishing material generally comprises a plurality of abrasive particles suspended in a resin binder that is disposed in discrete elements on a backing sheet. As the abrasive particles are contained in the polishing material itself, systems utilizing fixed abrasive polishing materials generally utilize polishing fluids that do not contain abrasives.

FIG. 1 generally depicts a schematic of a conventional chemical mechanical polishing system 100 that utilizes a web 102 of polishing material to process a substrate 116. The polishing system 100 generally includes a polisher 104 having at least one polishing station 106. The polishing station 106 includes a platen 108 and a polishing head 110. The web 102 of polishing material is supported by the platen 108 below the polishing head 110. Generally, the platen 108 (or polishing table) has a top surface 112 that supports a polishing area 114 of the web 102 where processing occurs. The substrate 106 retained by the polishing head 110 is pressed against the polishing area 114 and moved relative thereto during processing.

The polishing area 114 of the web 102 is held against the platen 108 during processing typically by tensioning the web 102 between a supply roll 118 and a take-up roll 120 that are disposed on opposite sides of the platen 108. The top surface 112 of the platen 108 may additionally contain a groove 122 that circumscribes the polishing area 114. The groove 122 is coupled to a vacuum source 124 so that air and other fluids that may be present between the web 102 and the platen 108 are evacuated through the groove 122, thus pulling the web 102 flush against the top surface 112 of the platen 108.

A problem that is periodically encountered when using webs of polishing material is maintaining the web flush against the polishing surface. For example, the tension applied to the web between the supply roll and the take-up roll may cause the web to wrinkle along the direction of the web. As some polishing systems may tension the web in excess of 300 pounds, the disparity in the longitudinal and lateral stresses in the web creates a tendency of the web to wrinkle. Additionally, the web may creep across the platen during polishing due to the sheer forces experienced as the substrate is moved in relation to the web during polishing. As the web creeps, wrinkles are created. The wrinkles that are not be completely removed (i.e., flattened out) by the vacuum applied under the web create a non-planar surface that may disrupt polishing uniformity. Moreover, wrinkles extending across the vacuum sealing area at the edge of the platen may cause seal failure, thus allowing the web to separate from the platen.

Therefore, there is a need for a method and apparatus that improves the retention of polishing material in a polishing station.

SUMMARY OF INVENTION

In one aspect of the invention, an apparatus for retaining a web of polishing material is provided. In one embodiment, an apparatus for retaining a web of polishing material includes a platen that has a first clamp and a second clamp disposed on opposite sides of the platen. A top surface of the platen is adapted to support the web of polishing material in an orientation having the web's edges disposed approximate the first and second sides of the platen. The first and second clamps are actuated to laterally tension the web therebetween.

In another aspect of the invention, a method for retaining a web of polishing material to a platen is provided. In one embodiment, the method includes the steps of disposing a web of polishing material on a platen and laterally tensioning the web.

BRIEF DESCRIPTION OF DRAWINGS

The teachings of the present invention can readily be understood by considering the following detailed description in conjunction with the accompanying drawings in which.

To facilitate understanding, identical reference numerals have been used, wherever possible, to designate identical elements that are common to the figures.

DETAILED DESCRIPTION OF INVENTION

Figure 1:
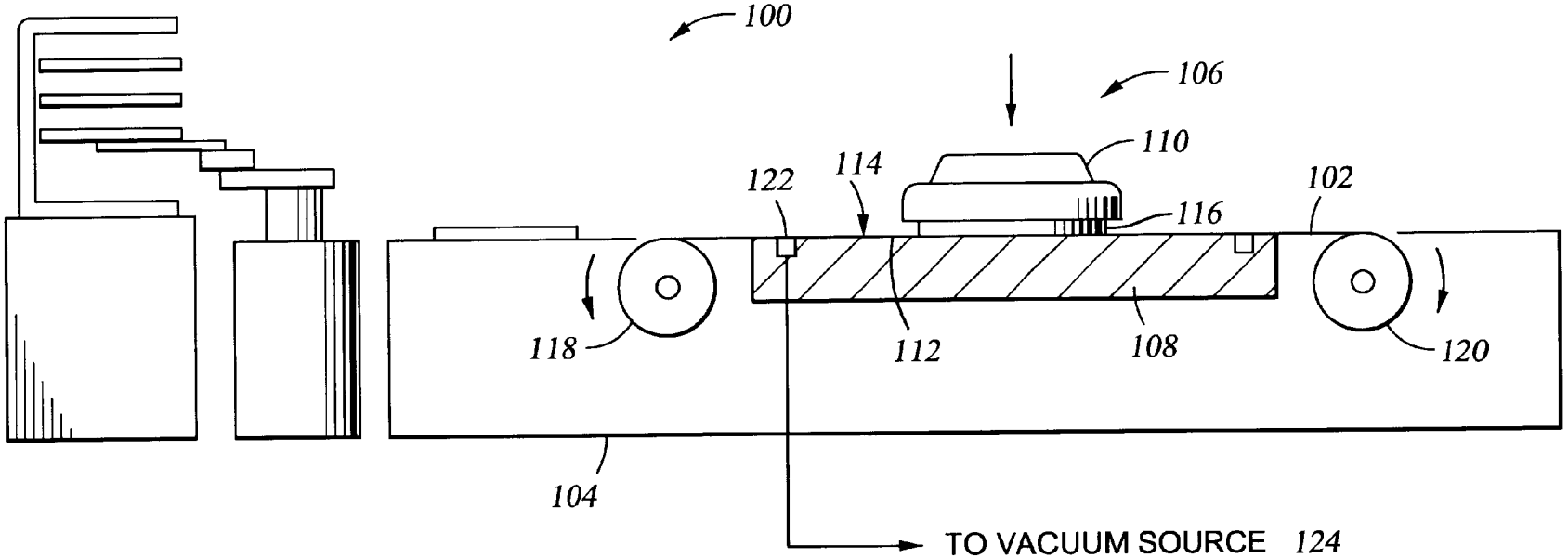
Fig. 1 (PRIOR ART)
FIG. 1 is a simplified schematic of a conventional polishing system.
Figure 2:
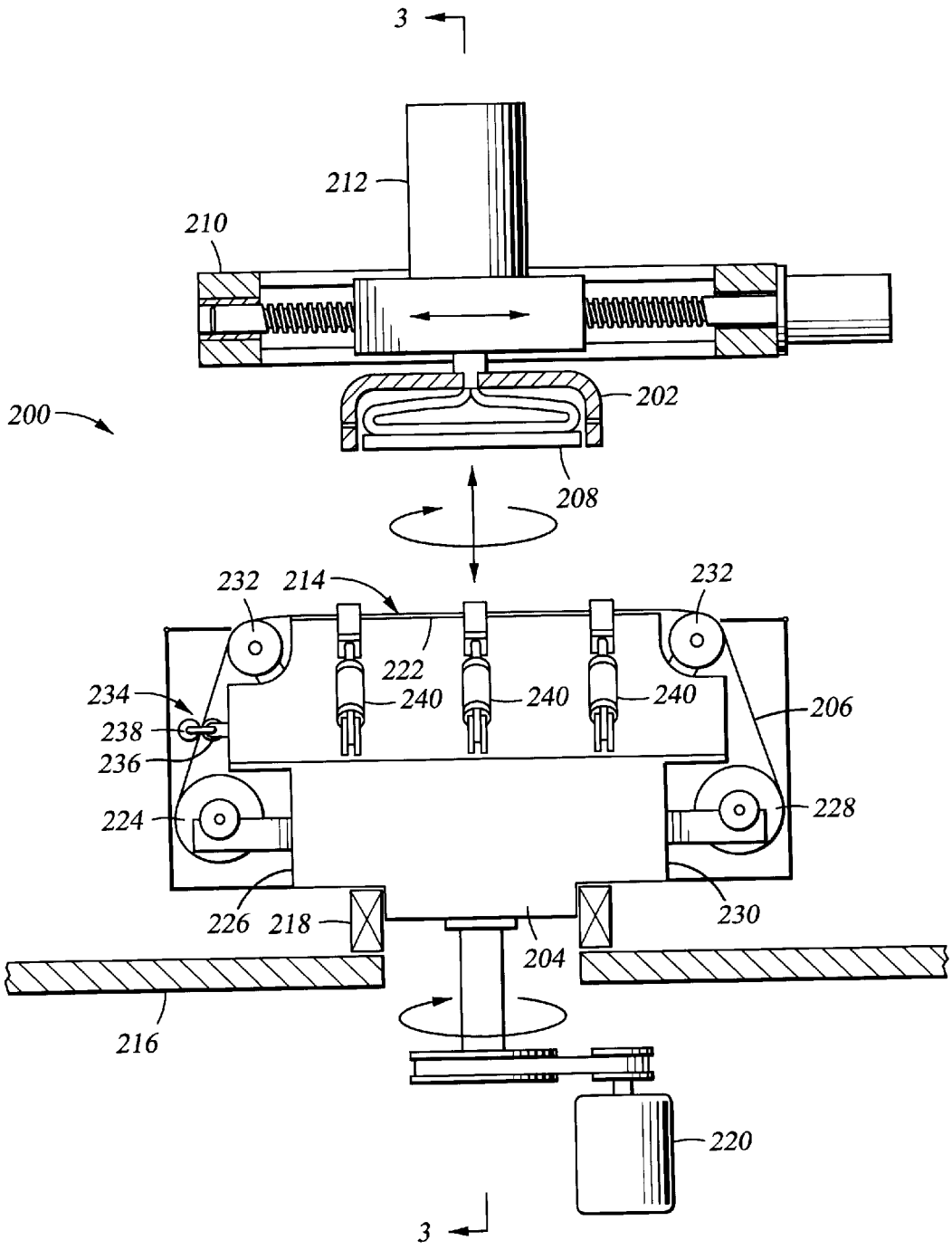
FIG. 2 is an elevation of one embodiment of a polishing station having a lateral web tensioner.

FIG. 2 depicts one embodiment of a polishing station 200 having one or more lateral web tensioners 240 associated therewith. An example of a polishing station which may be adapted to benefit from aspects of the invention is disclosed in U.S. patent application Ser. No. 09/144,456, filed Feb. 4, 1999 by Birang, et al. which is incorporated by reference herein in its entirety. Although the invention is described in reference to an illustrative polishing station 200, the invention has utility in other polishing stations that utilize webs of polishing material.

Generally, the polishing station 200 includes a polishing head 202 and a platen 204 that supports a web 206 of polishing material. The polishing head 202 generally retains a substrate 208 therein. The polishing head 202 presses the substrate 208 against a polishing area 214 of the web 206 during polishing. Generally, the substrate 208 and the web 206 of polishing material are placed in contact with and moved relative each other in the presence of a polishing fluid to planarize the substrate 208. The polishing head 202 is generally supported above the platen 204 by a carousel arm 210 (a portion of which is shown). The carousel arm 210 is generally utilized to transfer the polishing head 202 and substrate 208 between components (such as other polishing stations not shown) of a processing system of which the polishing station 200 shown is part of. A drive system 212 couples the polishing head 202 to the carousel arm 210 and provides motion to the polishing head 202 relative to the carousel arm 210. In one embodiment, the drive system 212 may provide rotation to the polishing head 202 about its axis. Optionally, the drive system 212 may be configured to move the polishing head 202 along the carousel arm 210. Generally, the drive system 212 actuates the polishing head 202 along a direction normal to the surface of a plane defined by the polishing area 214 of the web 206. In one embodiment, the polishing head 202 may be a TITAN II wafer carrier, available from Applied Materials, Inc. of Santa Clara, Calif.

The platen 204 is generally supported above a base 216 of the polishing station 200 by a bearing 218 so that the platen 204 may rotate in relation to the base 216. An area of the base 216 circumscribed by the bearing 218 is open and provides a conduit for the electrical, mechanical, pneumatic, control lines and connections communicating with the platen 204. Conventional bearings, rotary unions and slip rings (not shown) are provided such that electrical, mechanical, pneumatic, control signals and connections may be coupled between the base 216 and the rotating platen 204. The platen 204 is generally coupled to a motor 220 disposed below the base 216 that provides rotational motion to the platen 204.

The web 206 of polishing material is generally disposed across a top surface 222 of the platen 204. The unused portion of the web 206 of polishing material is typically stored on a supply roll 224 that is coupled to a first end 226 of the platen 204. A take-up roll 228 that stores a used portion of the web 206 of polishing material is generally coupled to a second end 230 of the platen 204. Generally, rollers 232 are disposed proximate the top surface 222 at each end 226, 230 of the platen 204 to prevent the web 206 of polishing material from becoming damaged by the platen 204 when moving across the top surface 222.

An indexer 234 is generally coupled to the first end 226 of the platen 204 between the supply roll 224 and the roller 232. In one embodiment, the indexer 234 includes a drive wheel 236 and a pinch roller 238. The portion of the web 206 of polishing material disposed between the supply roll 224 and the roller 232 is pinched between the drive wheel 236 and pinch roller 238 so that the drive wheel 236 may be controllably rotated to advance the web 206 thus pulling a portion of the web 206 from the supply roll. Generally, the take-up roll 228 is coupled to a tensioning device (not show) that winds a used portion of the web 206 equal in length to the amount of web 206 indexed. After the web 206 is advanced across the top surface 222, the tensioning device and/or indexer 234 tensions the web 206 along the web's length to pull the web 206 against the top surface 222 of the platen 204. In one embodiment, the web 206 is tensioned in excess of 300 pounds. Other types of indexers 234 may be alternatively provided.

Figure 3:
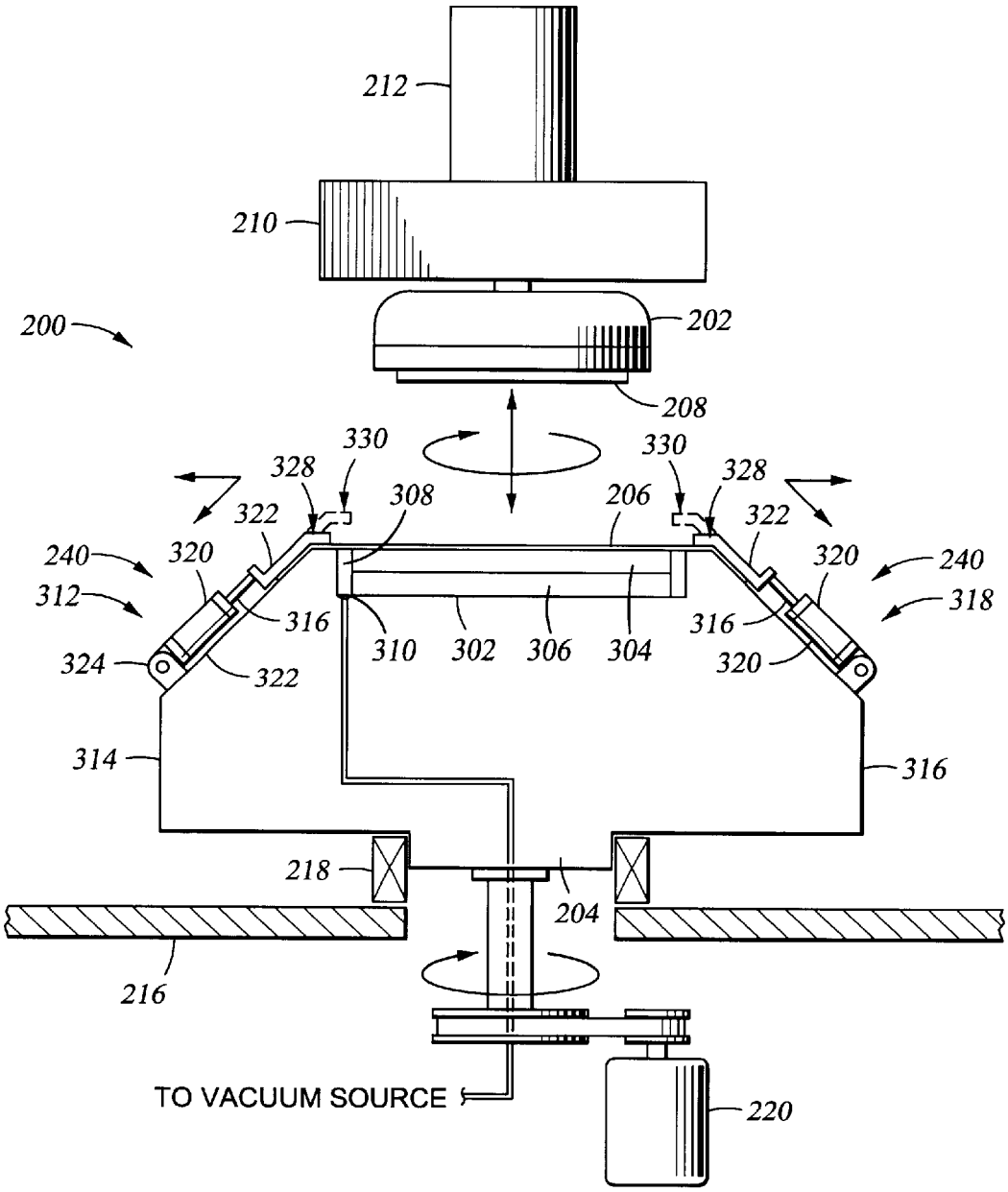
FIG. 3 is a sectional view of the polishing station along section line 3—3 of FIG. 2.

FIG. 3 depicts a cross-section of the polishing station 200. Generally, the top surface 222 of the platen 204 includes a center recess 302 extending into the top portion 222. A subpad 304 and a subplate 306 are disposed in the center recess 302. The subpad 304 is typically fabricated from a plastic such as polycarbonate, a foamed urethane or a plastic composite. Generally, the hardness or durometer of the subpad 304 is chosen to produce a particular polishing result. The subpad 304 generally maintains the web 206 of polishing material parallel to the plane of the substrate 208 held in the polishing head 202 and promotes global planarization of the substrate 208 or other polished profile. The subplate 306 is positioned between the subpad 304 and the bottom of the recess 302 such that the upper surface of the subpad is coplanar and defined by the top surface 222 of the platen 204.

Generally, the subpad 304 and the subplate 306 do not touch the side walls of the center recess 302, thus defining a channel 308 around the perimeter of the center recess 302. A vacuum port 310 is provided in the center recess 302 and is fluidly coupled to the channel 308. When a vacuum is drawn through the vacuum port 310, air and other fluids are removed between the web 206 of polishing material and the subpad 304, thus causing the web 206 of polishing material to be pulled against the subpad 304. An example of such a polishing material retention system is disclosed in U.S. patent application Ser. No. 09/258,036, filed Feb. 25, 1999 by Sommer, et al. which is hereby incorporated herein by reference in its entirety. The reader should note that other types of devices may be utilized to fix the web 206 to the platen 204.

To secure the web 206 flush against the top surface 222 of the platen 204, the lateral web tensioners 240 are disposed on sides of the platen 204 that are parallel to the edge of the web 206. In one embodiment, the tensioners 240 include a first set of clamps 312 that are disposed on a first lateral side 314 of the platen 204 and a second set of clamps 318 are disposed on a second, opposing side 316 of the platen 204. Generally, each set of clamps 312, 318 includes at least one actuator 320 and at least one clamp member 322. Alternatively, multiple actuators 320 may be coupled to a single clamp member 322 or the clamps 312, 318 may comprise a plurality of individual actuators 320 and clamp members 322 which may be actuated separately or in unison.

Typically, the actuator 320 is coupled to the platen 204 by a bracket 324. The actuator 320 may comprise an air cylinder, a pneumatic cylinder, a solenoid, a lead or ball screw or other type of linear actuator. The actuator 320 typically includes a piston 326 that is coupled to the clamp member 322. Generally, the actuator 320 is coupled to a controller (not shown) that signals the actuator 320 to displace the clamp member 322 between a first position 328 and a second position 330. Generally, when the clamp member 322 is moved to the second position 330, the web 206 of polishing material is urged laterally in a direction outward from the center of the platen 204. Thus, when both sets of clamp members 312, 318 are actuated on the opposing sides 314, 316 of the platen 204, the web 206 of polishing material is tensioned laterally therebetween thereby substantially removing wrinkles that may be present in the web 206. In one embodiment, each side 314, 316 of the platen 204 includes an upper chamfered portion 332. The actuator 320 generally is coupled to the upper chamfered portion 332 at an angle to the top surface 222 of the plate 204. When the actuator 320 is actuated in response to a signal, the clamp members 312, 318 move towards the actuator 320 in a downward, and outward motion. The clamp members 312, 318 come in contact with the web 206 of polishing material and urge the web 206 both outwardly and downwardly to laterally tension the web 206 therebetween.

In one embodiment, the top chamfered portion 332 may be configured so that the edge of the web 206 extends beyond the intersection of the chamfered portion 332 and the top surface 222. Alternatively, the upper chamfered portion 332 may be configured such that the edge of the web 206 remains entirely disposed on the top surface 222.

Figure 4:
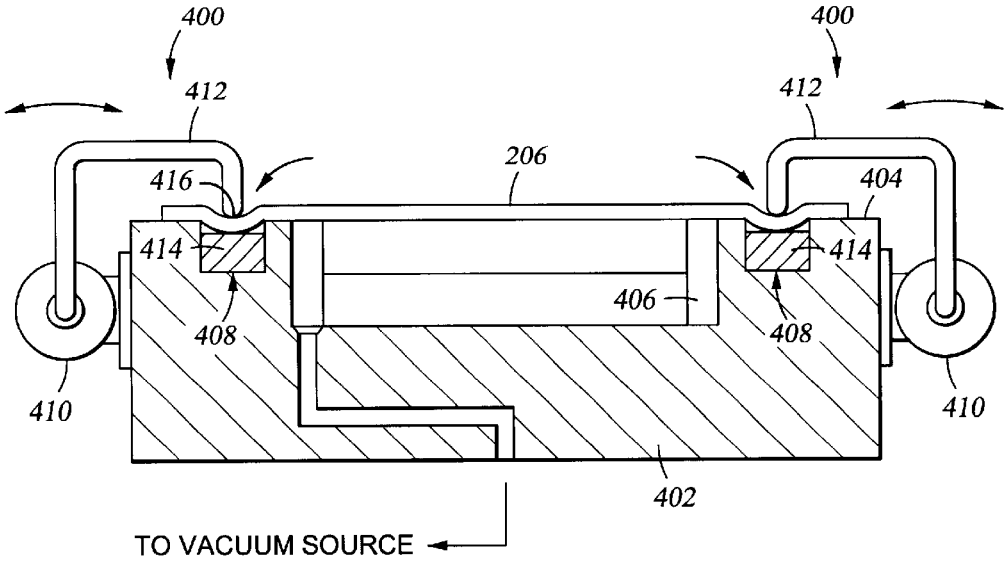
FIG. 4 depicts another embodiment of a lateral web tensioner coupled to a platen.

FIG. 4 depicts another embodiment of a platen 402 having a lateral web tensioner 400. The platen 402 is generally configured similarly to the platen 204 as described with reference to FIGS. 2 and 3 except that the tensioner 400 is configured to actuate using rotary motion. The platen 402 generally includes a top surface 404 having a vacuum channel 406 disposed therein. A groove 408 is disposed along the lateral sides of the platen 402 outward of the vacuum channel 406. The web 206 of polishing material is disposed across the top surface of the platen 402 in a manner so that the edges of the web 206 are outward of the groove 408.

The tensioner 400 generally comprises a rotary actuator 410 and a clamp member 412. The rotary actuator 410 is coupled to the platen 402. The clamp member 412 is coupled to the rotary actuator 410. Upon actuation of the rotary actuator 410, the clamp member 412 is rotated by the actuator and moved into contact with the web 206. The clamp member 412 urges the web 206 into the groove 408, thus displacing the web 206 into the groove 408 and pulling the web outward from the center of the platen 402. Alternatively, the groove 408 may be at least partially filled with an elastomeric or polymeric material 414.

The clamp member 412 generally includes a contact end 416 that contacts the web 206 during clamping. The contact end 416 typically has no sharp edges to prevent damaging the web 206. In one embodiment, the contact end 416 has a full radius. The length of the clamp member 412 may be adjusted to provide a predetermined contact area between the contact end 416 and the web 206.

Figure 5:
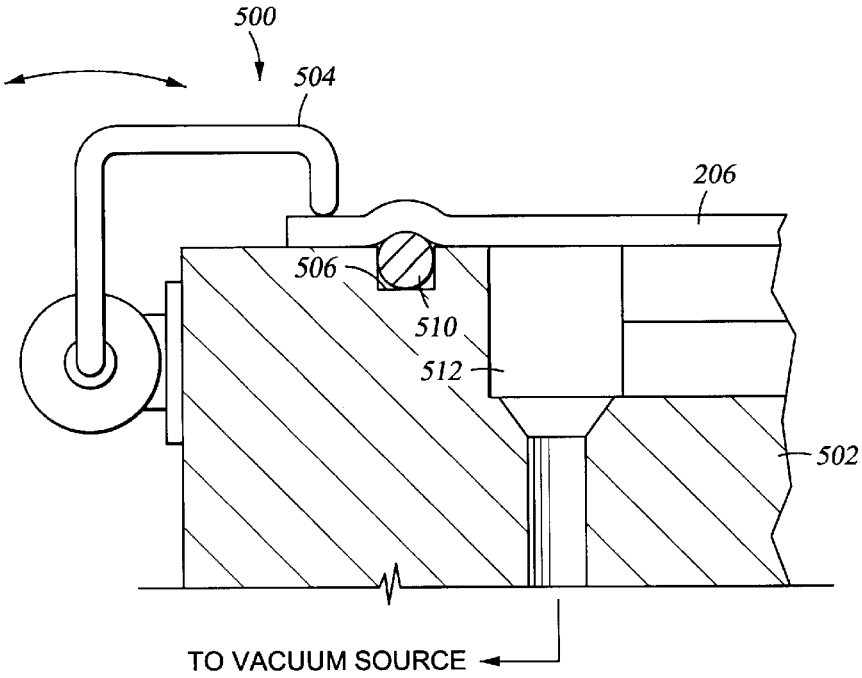
FIG. 5 depicts a partial sectional view of another embodiment of a lateral web tensioner coupled to a platen.

FIG. 5 depicts another embodiment of a platen 502 with a tensioner 500 for laterally tensioning the web 206 of polishing material. Generally, the platen 502 is configured similarly to the platen 402 as described with reference to FIG. 4 except that a clamp member 504 is configured to clamp the web 206 outward of a groove 506 on a top surface 508 of the platen 502. Generally, the platen 502 includes a projecting member 510 that elevates a portion of the web 206 of polishing material between the edge of the platen 502 and a vacuum channel 512 above the top surface 508. As the clamp member 504 is actuated to press the web 206 of polishing material against the top surface 508 of the platen 502, the web 206 is pulled over the projecting member 510 as it is clamped against the top surface 508, thus urging the web 206 outward from the center of the platen 502. Typically, the projecting member 510 is disposed at least about 0.125 inches from the vacuum channel 512 to avoid lifting the web 206 from the vacuum channel 512 during clamping. The projecting member 510 may be positioned in alternate locations depending on the height of the projecting member 510.

In one embodiment, the projecting member 510 comprises an elastomeric body, such as an o-ring disposed in the groove 510. Alternatively, the projecting member 510 may be a rigid member protruding from the platen 502.

Figure 6:
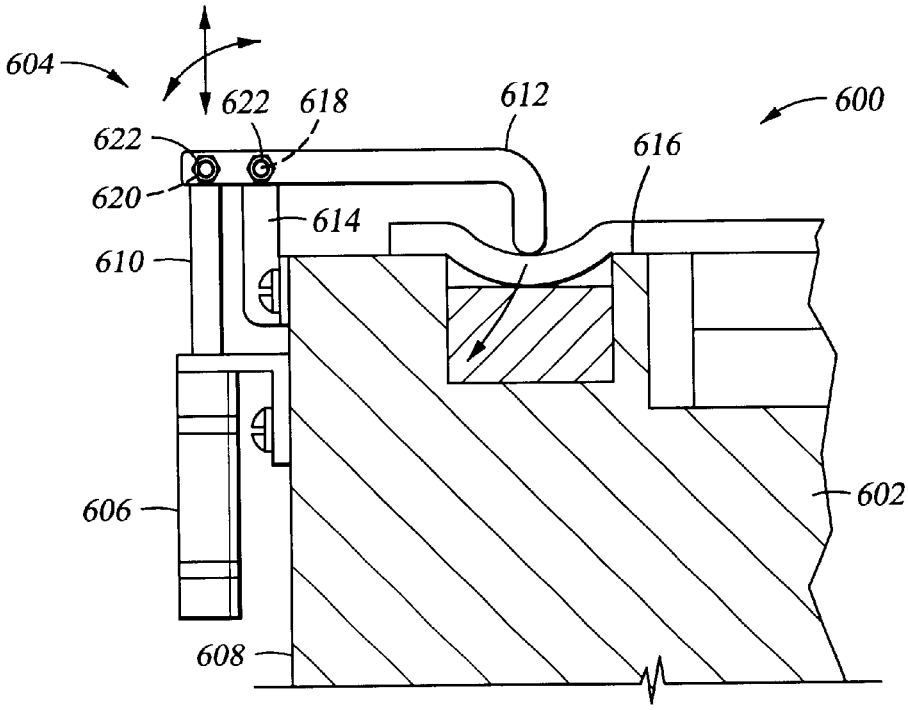
FIG. 6 depicts a partial sectional view of another embodiment of a lateral web tensioner coupled to a platen.

FIG. 6 depicts yet another embodiment of a platen 602 having a tensioner 600. Generally, the platen 602 is configured similar to the platen 402 as described with reference to FIG. 4 except wherein the tensioner 600 utilizes a linkage 604 to provide a force that urges the web 206 of polishing material outward. In one embodiment, the tensioner 600 includes an actuator 606, such as a pneumatic cylinder, that is coupled to a side 608 of the platen 602. A rod 610 extending from the actuator 606 is coupled to one end of a clamp member 612. A bracket 614 is disposed proximate a top surface 616 of the platen 602. The bracket 614 includes a hole 618 formed in one end. Typically, the bracket 614 is coupled to the platen 602 so that the hole 618 is positioned above the top surface 616 of the platen 602. The clamp member 616 includes a hole 620 disposed proximate the end of the clamp member 616 that is coupled to the actuator 606 and a second hole (not shown) that aligns with hole 618 in the bracket 614. A clevis pin 622 or other shaft is passed through the holes 618, 620 in the bracket 614 and the clamp member 612. As the end of the clamp member 612 that is coupled to the actuator 606 is urged in either direction by the actuator 606, the clamp member 612 is forced to rotate about the clevis pin 622 disposed in the bracket 614. The rotating clamp member 612 is urged against the web 206 of polishing material, displacing the polishing material into a groove 624 disposed in the top surface of the platen 602. Alternatively, the clamp member 612 may pull the web 206 over a member protruding from the platen 602. As the clevis pin 622 (i.e., the center of rotation) is above the top surface 616 of the platen 602, the force applied by the clamp member 612 to the web 206 of polishing material is tangential to the center rotation of the clamp member, thus urging the web 206 of polishing material both outwardly and downwardly.

Figure 7:
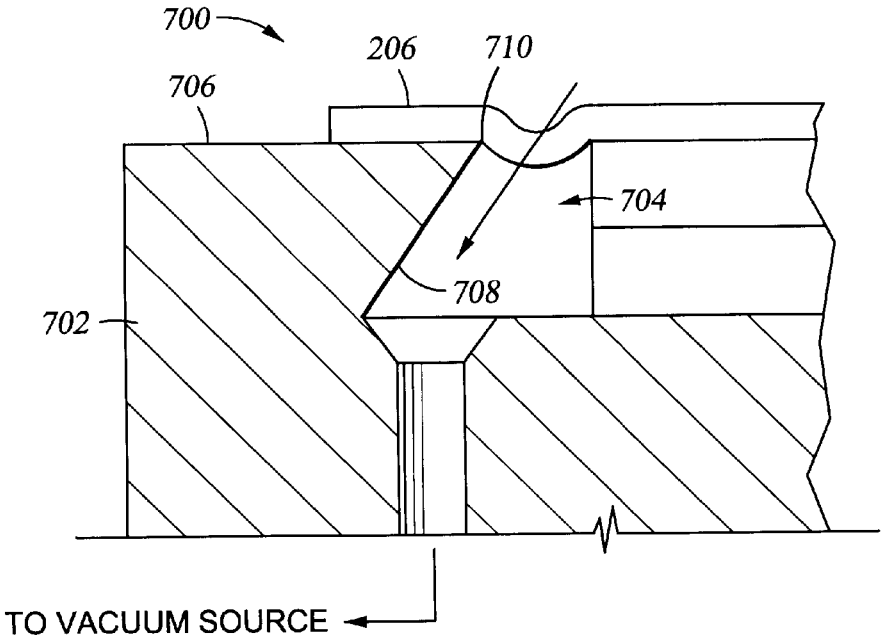
FIG. 7 depicts a partial sectional view of another embodiment of a lateral web tensioner disposed in a platen.

FIG. 7 depicts yet another embodiment of a platen 702 having a tensioner 700. Generally, the platen 702 includes a top surface 706 that supports the polishing material 206. The tensioner 700 generally includes groove 704 that is disposed in the top surface 706 and is coupled to a vacuum source. The groove 704 has an outer wall 708 that is orientated at an acute angle with the top surface 706, thus forming a sharp edge 710 where the wall 708 and top surface 706 meet. When vacuum is applied to the groove 704, the polishing material 206 is pulled downward into the groove 704. As the downward movement of the web 206 impinges against the sharp edge 710 of the groove 704, the edge 710 substantially prevents the portion of the web 206 outward of the edge 710 from moving into the groove 704. The portion of the web 206 inward of the groove 704 is thus pulled outward towards the groove 704 as the web 206 is pulled into the groove 704. Thus, the tensioner 700 pulls the web 206 outwardly and downwardly to laterally tension the web 206.

Although the teachings of the present invention that have been shown and described in detail herein, those skilled in the art can readily devise other varied embodiments that still incorporate the teachings and do not depart from the scope and spirit of the invention.

What is claimed is:

1. Apparatus for supporting a web of polishing material comprising:

a platen having a first side, a second side opposite the first side, and a top surface disposed between the first side and the second side, the top surface adapted to support the web of polishing material;

a first clamp coupled to the platen adjacent the first side;

a second clamp coupled to the platen adjacent the second side, wherein the first clamp and the second clamp are adapted to laterally tension the web therebetween; and a chamfered portion disposed between the first side and the top surface and having the first clamp coupled thereto.

2. The apparatus of claim 1, wherein the platen further comprises:

a second chamfered portion disposed between the second side and the top surface and having the second clamp coupled thereto.

3. The apparatus of claim 1, wherein the first clamp further comprises a linear or rotary actuator having a clamp member coupled thereto.

4. Apparatus for supporting a web of polishing material comprising:

a platen having a first side, a second side opposite the first side, and a top surface disposed between the first side and the second side, the top surface adapted to support the web of polishing material;

a first clamp coupled to the platen adjacent the first side; and a second clamp coupled to the platen adjacent the second side, wherein the first clamp and the second clamp are adapted to laterally tension the web therebetween, and wherein the top surface further comprises:

a first groove disposed adjacent the first side; and a second grove disposed adjacent the second side.

5. The apparatus of claim 4, wherein the first clamp and the second clamp each further comprise:

a clamp member adapted to urge the web at least partially into the first groove and the second groove, respectively.

6. The apparatus of claim 4 further comprising:

an elastomer disposed in the first groove, wherein the first clamp biases the web against the elastomer.

7. The apparatus of claim 1, wherein the top surface further comprises:

a member projecting from the top surface, wherein the clamp contacts the web outward of the projecting member.

8. The apparatus of claim 7, wherein the top surface further comprises:

a groove disposed along the first side, the projecting member disposed at least partially within the groove.

9. The apparatus of claim 1, wherein the web is laterally tensioned between the first clamp and the second clamp.

10. The apparatus of claim 9 further comprising:

an unwind roll coupled to a first end of the platen; and a take-up roll coupled to a second end of the platen, wherein the web is tensioned between the unwind roll and the take-up roll.

11. The apparatus of claim 10, wherein the top surface further comprises a vacuum groove.

12. Apparatus for supporting a web of polishing material comprising:

a platen having a chamfered lateral side;

a web of polishing material disposed on the platen;

a first clamp coupled to the platen, the first clamp having a clamp member disposed against a first edge of the web of polishing material; and a second clamp coupled to the platen, the second clamp having a clamp member disposed against a second edge of the web of polishing material, wherein the first clamp and the second clamp are adapted to laterally tension the web therebetween.

13. The apparatus of claim 12, where the web of polishing material is disposed partially on the chamfer.

14. A method for supporting a web of polishing material comprising the steps of:

disposing a web of polishing material on a platen; and laterally tensioning the web by clamping the edges of the web in a downwardly and outwardly motion.

15. The method of claim 14, wherein the step of tensioning further comprises the step of:

clamping the edges of the web against a groove disposed in the platen.

16. The method of claim 14, wherein the step of clamping further comprises the step of:

rotating a clamp member to bias the web against the platen.

17. The method of claim 16, wherein the step of clamping further comprises the step of:

biasing the web against an elastomer disposed in the groove.

18. The method of claim 16, wherein the step of clamping further comprises the step of:

urging the web at least partially into the groove.

19. The method of claim 14 further comprising the steps of:

pressing the workpiece against the polishing material; and providing relative motion between the workpiece and the polishing material.

20. The method of claim 14 further comprising the steps of:

releasing the lateral tension on the web; and advancing the web across the platen.

21. The method of claim 20 further comprising the step of:

re-laterally tensioning the web after the advancing step.

22. The apparatus of claim 1, wherein the first clamp further comprises:

a clamp member having a first position and a second position, the second position biased against the platen.

23. The apparatus of claim 1, wherein the first clamp further comprises:

a clamp member having a first position and a second position, the second position outward and downward of the first position.

24. The apparatus of claim 4, wherein the first clamp further comprises:

a clamp member having a first position and a second position, the second position biased against the platen.

25. The apparatus of claim 4, wherein the first clamp further comprises:

a clamp member having a first position and a second position, the second position outward and downward of the first position.

26. The apparatus of claim 4, wherein the platen further comprises:

a first chamfered portion disposed between the first side and the top surface and having the first clamp coupled thereto; and a second chamfered portion disposed between the second side and the top surface and having the second clamp coupled thereto.

27. The apparatus of claim 4, wherein the platen further comprises:

a chamfered portion disposed between the first side and the top surface and having the first clamp coupled thereto; and a linear or rotary actuator the first clamp coupled thereto.

28. The apparatus of claim 1, wherein the top surface further comprises:

a first groove disposed adjacent the first side; and a second groove disposed adjacent the second side.

29. The apparatus of claim 28, wherein the first clamp and the second clamp each further comprise:

a clamp member adapted to urge the web at least partially into the first groove and the second groove, respectively.

30. The apparatus of claim 28 further comprising:

an elastomer disposed in the first groove, wherein the first clamp biases the web against the elastomer.

31. The apparatus of claim 4, wherein the top surface further comprises:

a member projecting from the top surface, wherein the clamp contacts the web outward of the projecting member.

32. The apparatus of claim 31, wherein the projecting member is disposed at least partially within the groove.

33. The apparatus of claim 4, wherein the web is laterally tensioned between the first clamp and the second clamp.

34. The apparatus of claim 33 further comprising:

an unwind roll coupled to a first end of the platen; and a take-up roll coupled to a second end of the platen, wherein the web is tensioned between the unwind roll and the take-up roll.

35. The apparatus of claim 34, wherein the top surface further comprises a vacuum groove.

36. The apparatus of claim 4, wherein first clamp is adapted to urge the web into the first groove.

37. The apparatus of claim 12, wherein the first clamp member and the second clamp member move outwardly and downwardly to bias the web.

* * * * *